United States Patent [19]

Geary

[11] Patent Number: 4,971,549

[45] **Date of Patent: * Nov. 20, 1990**

[54] FUEL CONTROL UNIT FOR A GAS FURNACE AND METHOD OF MAKING THE SAME

[75] Inventor: Frederick J. Geary, Holland, Mich.

[73] Assignee: Robertshaw Controls Company, Richmond, Va.

[ * ] Notice: The portion of the term of this patent subsequent to Sep. 12, 2006 has been disclaimed.

[21] Appl. No.: 380,893

[22] Filed: Jul. 14, 1989

Related U.S. Application Data

[63] Continuation of Ser. No. 235,374, Aug. 23, 1988, Pat. No. 4,865,539.

[51] Int. Cl.[5] ..... F23Q 9/08

[52] U.S. Cl. ..... 431/46; 431/60; 431/75; 431/18

[58] Field of Search ..... 431/25, 42, 46, 60, 431/43, 50, 74, 78, 90, 75; 340/579; 126/116 A

[56] References Cited

U.S. PATENT DOCUMENTS

| | | | |
|---|---|---|---|
| 3,766,441 | 10/1973 | Gray | 431/78 X |
| 4,070,143 | 1/1978 | Dietz | 431/46 X |
| 4,269,589 | 5/1981 | Matthews | 431/46 |
| 4,435,150 | 3/1984 | Rippelmeyer | 431/46 |
| 4,626,192 | 12/1986 | Geary | 431/46 |
| 4,865,539 | 9/1989 | Geary | 431/46 |

*Primary Examiner*—Carl D. Price

*Attorney, Agent, or Firm*—Candor, Candor and Tassone

[57] ABSTRACT

A control unit for a gas furnace that has an electrically operable pilot gas valve and an electrically operable main gas valve and a method of making the control unit are provided, the control unit comprising an electrical circuit having a gas valve section that comprises a silicon controlled rectifier and a first capacitor and a second capacitor so electrically interconnected together that the capacitors are adapted to be charged on each half wave cycle of a certain polarity of an alternative current source that is imposed on the circuit and that second capacitor is adapted to discharge through a relay coil that controls the gas valve to energize that relay coil only when the silicon controlled rectifier conducts, the silicon controlled rectifier being adapted to conduct only when the first capacitor is discharged, another section of the electrical circuit being adapted to discharge the first capacitor only on each half wave cycle of the other polarity of the alternative current source.

6 Claims, 2 Drawing Sheets

FUEL CONTROL UNIT FOR A GAS FURNACE AND METHOD OF MAKING THE SAME

CROSS REFERENCE TO RELATED APPLICATIONS

This application is a continuation patent application of its copending parent patent application, Ser. No. 234,374, filed Aug. 23, 1988, now U.S. Pat. No. 4,865,539.

BACKGROUND OF THE INVENTION

1. Field of the Invention

This invention relates to a new fuel control system for a gas furnace or the like and as to a new method of making such a system.

2. Prior Art Statement

It is known to provide a control means for a gas furnace that has an electrically operable pilot gas valve means and an electrically operable main gas valve means, the control means comprising an electrical circuit means adapted to be interconnected to a source of alternating current so as to have alternating half wave cycles of one polarity and half wave cycles of the opposite polarity, the circuit means having a flame sense section and a main gas valve means section, the main gas valve means section comprising a main relay coil means which when energized by the circuit means is adapted to operate the main gas valve means to direct main gas to the furnace, the flame sense section comprising a control unit that is adapted to energize the main coil means on each half wave cycle of the one polarity thereof only when a flame sense probe means generates a voltage through flame rectification thereof caused by pilot flame means of said furnace impinging on said probe means. For example, see the Geary U.S. Pat. No. 4,626,192.

SUMMARY OF THE INVENTION

It is one feature of this invention to provide a new fuel control means for a gas furnace or the like wherein a silicon controlled rectifier is utilize to control a relay means of a gas valve in a unique manner.

In particular, it is believed that it is not normally wise to use a silicon controlled rectifier to control a gas valve or a relay which then controls a gas valve because one of the failure modes of a silicon controlled rectifier is that the same can degenerate into a non-controlled rectifier and thereby could cause a gas flow which is uncontrolled.

However, it was found according to the teachings of this invention that the valve relay control circuits of of the fuel control systems set forth in the aforementioned Geary U.S. Pat. No. 4,626,192 each can utilize a single silicon controlled rectifier to control a valve actuating relay in such a manner that gas flow would cease should the silicon controlled rectifier degenerate into a non-controlled rectifier.

In addition, it was found according to the teachings of this invention that each unique valve relay control circuit of this invention reduces the component count by one transistor in the valve circuit and replaces a seven watt resistor with a smaller one watt resistor in the valve relay control circuit thereby reducing the ambient temperature created by the control means which, of course, reduces stress on all components thereof.

In addition, it was found that by utilizing the new valve relay control circuits of this invention, the resulting control means utilizes less space in the furnace application thereof because of the smaller circuit board required for this design.

Thus, one embodiment of this invention provides a control means for a gas furnace that has an electrically operable pilot gas valve means and an electrically operable main gas valve means, the control means comprising an electrical circuit means adapted to be interconnected to a source of alternating current so as to have alternating half wave cycles of one polarity and half wave cycles of the opposite polarity, the circuit means having a flame sense section and a main gas valve means section, the main gas valve means section comprising a main relay coil means which when energized by the circuit means is adapted to operate the main gas valve means to direct main gas to the furnace, the flame sense section comprising a control unit that is adapted to energize the main relay coil means on each half wave cycle of the one polarity thereof only when a flame sense probe means generates a voltage through flame rectification thereof caused by pilot flame means of the furnace impinging on the probe means, the main gas valve means section comprising a silicon controlled rectifier and a first capacitor and a second capacitor so electrically interconnected together that the capacitors are adapted to be charged on each half wave cycle of the opposite polarity thereof and that the second capacitor is adapted to discharge through the main relay coil means to energize the main relay coil means only when the silicon controlled rectifier conducts, the silicon controlled rectifier being adapted to conduct only when the first capacitor is discharged, the flame sense section being adapted to discharge the first capacitor only on each half wave cycle of the one polarity thereof.

Accordingly, it an object of this invention to provide a new control means for a gas furnace or the like, the control means of this invention having one or more of the novel features of this invention as set forth above or hereinafter shown or described.

Another object of this invention is to provide a new method of making a control means for a gas furnace or the like, the method of this invention having one or more of the novel features of this invention as set forth above or hereinafter shown or described.

Other objects, uses and advantages of this invention are apparent from a reading of this description which proceeds with reference to the accompany drawings forming a part thereof and wherein:

BRIEF DESCRIPTION OF THE DRAWINGS

FIG. 1A and FIG. 1B respectfully illustrate two parts of the control means of this invention and when placed together with the phathom line Line 1B–1B of FIG. 1A placed on the phathom line 1A–1A of FIG. 1B, the joined FIGS. 1A and 1B will illustrate the entire control means of this invention for a gas furnace or the like.

DESCRIPTION OF THE PREFERRED EMBODIMENT

Figure 1A:
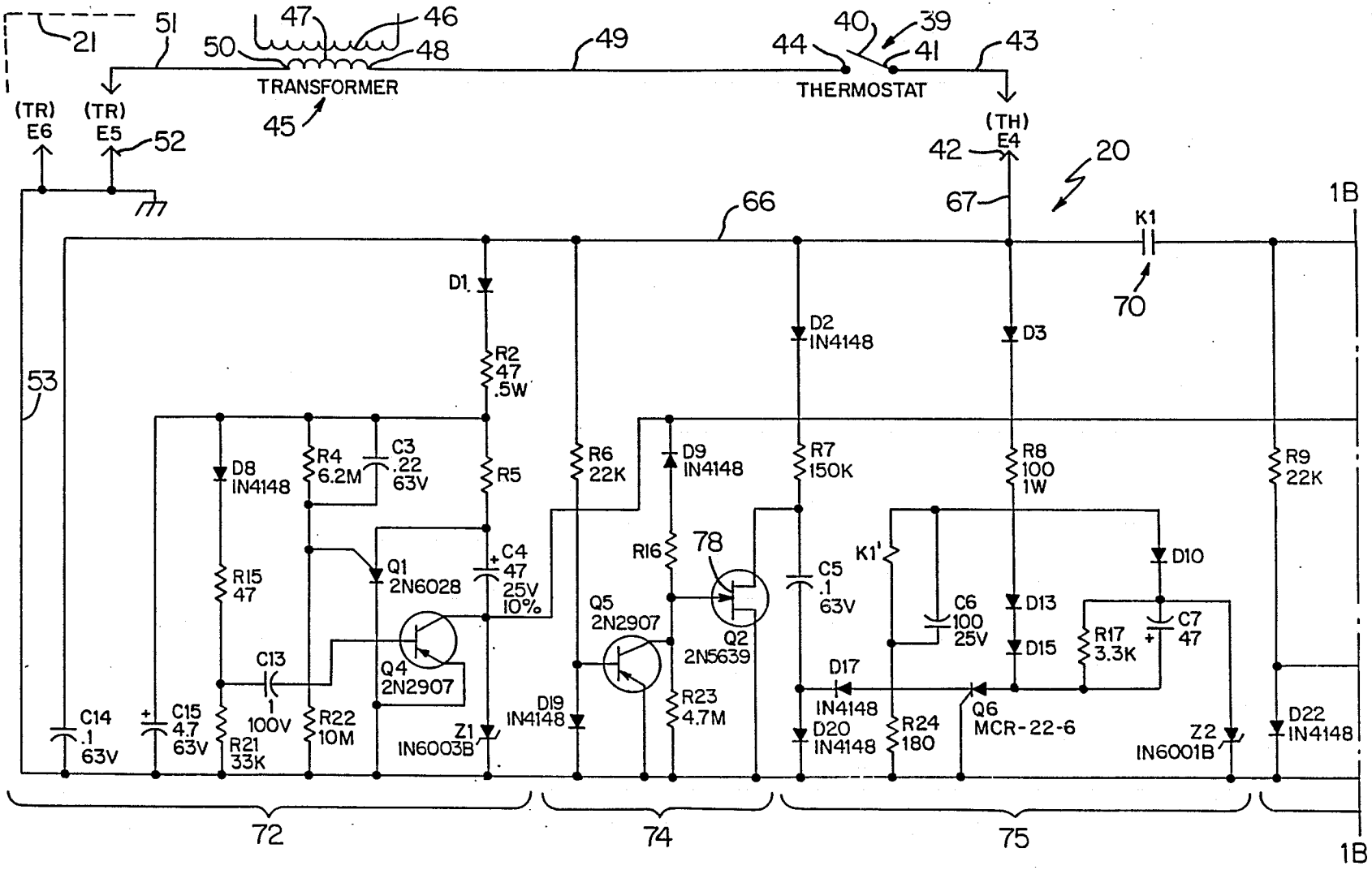

While the various features of this invention are hereinafter illustrated and described as being particularly adapted to provide relay control circuits for gas valves that are adapted to be utilized with the various control circuits of the aforementioned Geary U.S. Pat. No. 4,626,192, it is to be understood that the various features of this invention can be utilized singly or in various combinations thereof to provide relay control circuits to be utilized with other control means as desired.

Therefore, this invention is not to be limited to only the embodiment illustrated in the drawings, because the drawings are merely utilized to illustrate one of the wide variety of uses of this invention.

Figure 1B:
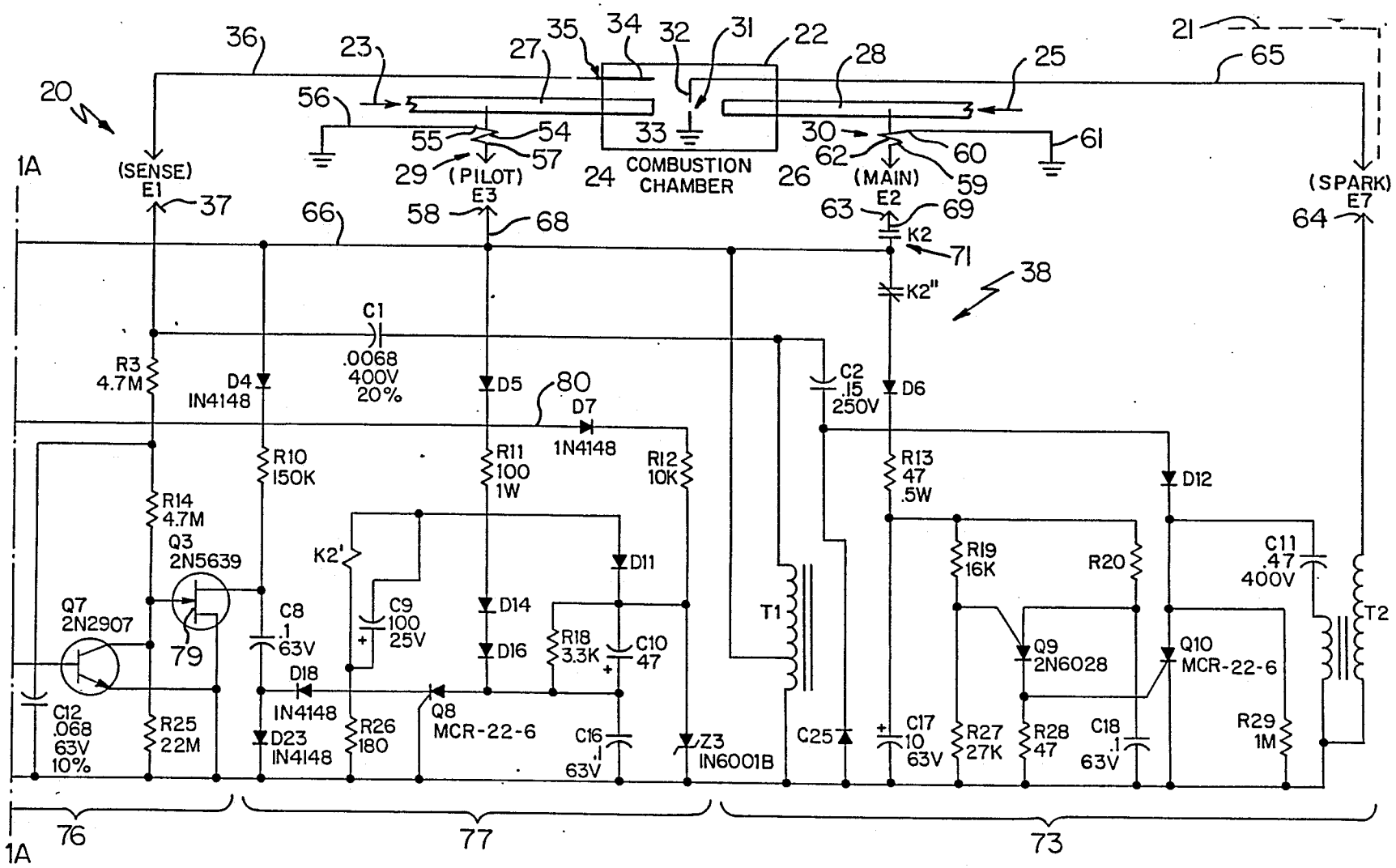

Referring now to FIGS. 1A and 1B, the new control means of this invention is generally indicated by the reference numeral 20 and is being utilized to control a gas furnace 21 that comprises a combustion chamber 22 adapted to be supplied with pilot gas from a source 23 thereof to a pilot burner 24 thereof and to be supplied with main gas from a supply 25 thereof to a main burner means thereof 26 respectively through passage means 27 and 28 that are respectively controlled by electrically operable pilot gas valve means 29 and main gas valve means 30, such combustion chamber 22 and electrically operable gas valve means 29 and 30 being conventional in the art. For example, see the aforementioned Geary U.S. Pat. No. 4,626,192 whereby this patent is being incorporated into this disclosure by this reference thereto.

The control means 20 of this invention includes an electrical spark generating means that is generally indicated by the reference numeral 31 and is disposed in the combustion chamber 22 in such a manner that the same is adapted to ignite fuel issuing from the pilot burner means 24 when an electrical current is pulsed to one electrode 32 of the spark generating means 31 to spark across a spark gap thereof to a grounded electrode 33 thereof all in the manner set forth in the aforementioned Geary U.S. Pat. No. 4,626,192.

The flames of the ignited pilot burner means 24 are adapted to ignite the fuel issuing from the main burner means 26 and a probe 34 of a flame sense means 35 is adapted to generate a negative voltage through flame rectification thereof also in the manner fully set forth in the aforementioned Geary U.S. Pat. No. 4,626,192, such negative voltage being transmitted by an electrical lead 36 to a flame sense terminal 37 of an electrical circuit means of this invention that is generally indicated by the reference numeral 38 and comprises part of the control means 20 as will be apparent hereinafter.

The control means 20 of this invention also comprises a conventional thermostat that is generally indicated by the reference numeral 39 and comprises a switch blade means 40 that has one end 41 thereof electrically interconnected to a terminal 42 of the circuit means 38 by an electrical lead means 43, the switch blade 40 being adapted to be closed against a fixed contact means 44 when the thermostat means 39 senses that the temperature of the area being controlled by the output effect of the furnace 21 has fallen below the selected set point temperature of the thermostat means 39 and opening away from the fixed contact means 44 when such sensed temperature is above such selected set point temperature all in a manner well known in the art.

The control means 20 also includes a transformer means 45 that has a primary coil 46 for receiving alternating current therethrough from a source of alternating current, such as the conventional 110/120 volt and 50/60 cycle source provided for houses, buildings and the like that normally utilized gas furnaces and the like.

The transformer 45 comprises a secondary winding or coil 47 for stepping down the high voltage alternating current of the primary coil 46 to a low voltage alternating current source for the control means 20 of this invention, such as 24 volts of alternating current with the alternating current alternating at a rate of approximately 50/60 cycles per minute. One side 48 of the secondary coil 47 of the transformer 45 is interconnected by a lead means 49 to the fixed contact means 44 of the thermostat 39 while the other side 50 of the secondary coil 47 is interconnected by a lead means 51 to a terminal 52 of the circuit means 38 that is interconnected to ground and, thus, to a grounded conductive line 53 of the circuit means 38.

Thus, it can be seen that when the thermostat means 39 closes the switch blade 40 against the fixed contact means 44, the transformer 45 is adapted to impose a source of alternating current on the circuit means 38 because of the terminal means 42 and 52 thereof whereby the circuit means 38 has alternating half wave cycles of one polarity and half wave cycles of the opposite polarity imposed thereon to operate the control means 20 in a manner hereinafter set forth.

The electrically operable pilot gas valve means 29 is illustrated as having an operating coil 54 having one side 55 thereof interconnected to ground by a lead means 56 and the other side 57 thereof interconnected to a terminal 58 of the circuit means 38 so that the pilot gas valve means 29 is adapted to interconnect the gas source 23 to the pilot burner means 24 when the coil means 54 is energized by the circuit means 38 of this invention in a manner hereinafter set forth.

Similarly, the main gas valve means 30 comprises an electrical coil means 59 having one side 60 thereof interconnected to ground by a lead means 61 and the other side 62 thereof interconnected to a terminal 63 of the circuit means 38 so that the main gas valve means 30 is adapted to interconnect the gas source 25 to the main burner means 26 when the circuit means 38 energizes the coil 59 thereof in a manner hereinafter set forth.

The spark electrode 32 of the electrical spark means 32 is adapted to be interconnected to a terminal 64 of the circuit means 38 by a lead means 65 so that the spark means 31 is adapted to create electrical sparks when the circuit means 38 energizes the electrode 32 is a manner hereinafter set forth.

The terminal 42 of the circuit means 38 is interconnected to a main conductive line 66 of the circuit means 38 by a conductive line 67. Similarly, the terminal 58 is interconnected to the line 66 by a conductive line 68 and the terminal 63 is interconnected to the line 66 by a conductive line 69. However, the line 66 has normally open contact means K1 therein at a point intermediate the lines 66 and 68 so that the electrically operable pilot gas valve means 29 cannot be energized by the circuit 38 unless the contacts K1 are closed.

Similarly, the line 69 that leads from the main line 66 of the circuit means 38 to the main gas valve means 30 has normally open contacts K2 disposed therein so that the electrical circuit means 38 cannot energize the coil means 59 of the main gas valve means 30 unless both the normally open contacts K1 and K2 are closed as will be apparent hereinafter.

The normally open contacts K1 are part of a first electrically operated relay means that is generally indicated by the reference numeral 70 that has a coil means K1' as illustrated in FIG. 1A which must be energized by the circuit means 38 to close the contacts K1 in a manner hereinafter set forth.

Similarly, the normally open contacts K2 comprise part of another electrically operated relay means that is generally indicated by the reference numeral 71 and has a coil means K2' disposed in the circuit means 38 as illustrated in FIG. 1B so that the coil means K2' must be energized by the circuit means 38 in a manner hereinafter set forth in order to close the normally open contacts K2.

The relay means 71 also has normally closed contacts K2" which are disposed in the circuit means 38 as illustrated in FIG. 1B and open only when the coil K2' is energized by the circuit 38, the normally closed contacts K2" controlling the electrical spark means 31 in a manner hereinafter set forth.

The electrical circuit means 38 of this invention can comprise a printed circuit board means and can be considered as having circuit sections 72, 73, 74, 75, 76 and 77 with the circuit section 72 providing a prepurge/-valve timing function, the section 73 comprising a spark igniting circuit for the control means 20, the section 74 comprising a control circuit that controls the operation of the circuit section 75, the circuit section 75 comprising the pilot valve relay control circuit, the circuit section 76 comprising a control circuit for controlling the circuit section 77 and the circuit section 77 comprising the main gas valve relay control circuit.

The various components of the electrical circuit means 38 comprises the resistors, diodes, capacitors, transistors, field effect transistors and silicon controlled rectifiers electrically interconnected together between the main line 66 and grounded line 53 of the circuit means 38 in the manner fully illustrated in the drawings with the values of such components being set forth in FIGS. 1A and 1B where all resistance values are in ohms, 25W, 5%; all capacitant values are in microfarads, 50V, 20% and all diodes are IN 4004 unless otherwise indicated in the drawings. In regard to resistors R5, R16 and R20, various values can be utilized therefor depending upon the desired operation of the control means 20 and in one working embodiment thereof R5 comprises 620K, 0.25W, 2%; R16 comprises 430K, 0.25W, 2% and R20 comprises 1.3M, 0.25W, 5%.

In general, the prepurge/timing circuit section 72, the ignition spark controlling circuit section 73 and the control circuit sections 74 and 76 are substantially the same in structure and function as like sections in the FIG. 4 embodiment of the aforementioned Geary U.S. Pat. No. 4,626,192, so that basically only the valve relay control circuit section 75 and 77 of the circuit means 38 of this invention differ from the valve relay control circuits set forth in the FIG. 4 embodiment of the aforementioned Geary U.S. Pat. No., 4,626,192, whereby only the details of the valve/relay control circuits 75 and 77 of the circuit means 38 of this invention will be more fully described hereinafter with only sufficient details of the other circuit sections 72, 73, 74 and 76 being described in order to fully understand the new features of this invention.

In general, the control means 20 of this invention operates in the following manner.

When the thermostat means 39 senses a temperature that requires the furnace 21 to produce heat, the thermostat construction 39 closes the switch blade 40 against the fixed contact means 44 so that the transformer 45 imposes the low voltage alternating current onto the circuit means 38. However, since the circuit means 38 cannot apply the current to energize the coil K1' of the relay means 40 and to energize the spark igniter circuit section 73 when the contacts K1 are open, the pilot gas valve means 29 is in its closed condition and the spark circuit section 73 cannot operate. However, the low voltage alternating current is initially applied to the timing circuit section 72 of the circuit means 38 and after a prepurge timing operation from approximately 1.3 to approximately 45 seconds, the capacitor C4 operates the control circuit section 74 which, in turn, operates the pilot gas valve relay control circuit 75 to energize the relay coil K1' and thereby case the normally open contacts K1 to close. Once the contacts K1 close, the coil 54 of the pilot gas valve means 29 is energized so that the same interconnects the pilot gas source 23 with the pilot burner 24 so that the pilot gas can issue therefrom into the combustion chamber 22. At the same time that the contacts K1 close, the spark igniter circuit 73 is energized as the contacts K2" are in a closed condition so that sparks are generated across the space between the electrodes 32 and 33 to ignite the gas issuing from the pilot burner means 24. Once the flames exist at the pilot burner means 24, the flame sense probe 34 generates a negative voltage which is transferred by the terminal 37 to the control circuit section 76 which then causes the main gas valve relay control circuit section 77 to operate and thereby energize the coil K2' of the relay means 71. Once the coil K2' of the relay means 71 is energized, the same causes the normally open contacts K2 to close and the normally closed contacts K2" to open. The opening of the contacts K2" terminates the sparking at the spark igniter means 31 by removing the source of electrical current from the spark igniter section 73 of the circuit means 38 and permits the electrical current to now energize the coil 59 of the main gas valve means 30 and thereby interconnect the main gas source 25 to the main burner means 26. The gas now issuing from the main burner means 26 is ignited by the flames of the pilot burner means 24 and as long as flame means exist at the pilot burner means 24, the voltage being generated by the flame sensing probe 34 not only maintains the control circuit section 76 in operation to maintain the coil means K2' of the relay control circuit 77 energized, but also such voltage being generated by the flame sense means 35 also maintains the operation of the control circuit section 74 so as to maintain the energization of the coil K1' of the pilot relay control circuit 75 so that the contacts K1 remain closed.

Thus, pilot burner gas and main burner gas continue to issue from the pilot burner means 24 and main burner means 26 as long as the thermostat means 39 maintains the switch blade 40 in a closed condition against the fixed contact means 44. However, once the thermostat means 39 senses that the output temperature effect now being produced by the furnace 21 has risen above the selected set point temperature of the thermostat means 39, the switch blade 40 opens away from the fixed contact means 44 and thereby removes electrical current from the circuit means 38 so that the pilot gas valve means 29 and main gas valve means 30 close to terminate the flow of any gas to the combustion chamber 22. Also the now deenergized coil means K1' causes the contacts K1 to open. At the same time, the electrical current is removed from the coil K2' of the relay means 71 so that the contacts K2 open and the contacts K2" close whereby the circuit means 38 remains in the condition as illustrated in FIGS. 1A and 1B until the thermostat construction 39 again closes and operates the control means 20 in the manner previously set forth. Thus, the control means 20 causes the furnace to cycle in the above manner to tend to maintain the space being heated thereby at the selected set point temperature of the thermostat means 39.

The details of the valve relay control circuit sections 75 and 77 of this invention will now be described.

It can be seen that the pilot gas valve relay control circuit section 75 and the main gas valve relay control circuit section 77 are substantially the same, the pilot gas valve relay control circuit 75 comprising the capacitors C5, C6 and C7, diodes D2, D3, D10, D13, D15, D17 and D20, resistors R7, R8, R17 and R24, zener diode Z2 and the silicon controlled rectifier Q6 all being electrically interconnected in the manner illustrated in FIG. 1A along with relay coil K1'. The main gas valve relay control circuit section 77 comprises capacitors C8, C9, C10 and C16, diodes D4, D5, D11, D14, D16, D18 and D23, resistors R10, R11, R12, R18 and R26, zener diode Z3 and a silicon controlled rectifier Q8 all electrically interconnected together with the relay coil K2" as illustrated in FIG. 1B.

The control circuit section 74 for the pilot valve relay control circuit section 75 includes the field effect transistor Q2 and the trigger transistor Q5 so interconnected together in the manner illustrated in FIG. 1A so that if there is a negative voltage on the gate 78 of the field effect transistor Q2, the output of the field effect transistor Q2 is a square wave at a 50/60 cycle rate caused by the transistor Q5 cyclically shorting out the gate 78 of the field effect transistor Q2 to ground, the square wave voltage at the drain terminal of the field effect transistor Q2 being in phase with the 24 volt transformer voltage as this phasing is controlled by the transistor Q5.

Thus, the field effect transistor Q2 will not conduct unless a negative voltage is imposed on the gate 78 thereof and such negative voltage is provided on the gate 78 of the field effect transistor Q2 by the timing circuit section 72 having charged the capacitor C4 to a specified voltage and then allowing it to discharge through the timing resistor R16.

The transistor Q5 causes the field effect transistor Q2 to conduct on each half wave cycle of negative polarity which essentially grounds the anode of the capacitor C5 causing it to discharge through Q2, D17 and R24 so as to develop a voltage across the resistor R24 with a polarity such as to cause the cathode of the silicon controlled rectifier Q6 to be negative with respect to its gate forcing the silicon controlled rectifier Q6 into conduction. Conduction of the silicon controlled rectifier Q6 allows discharge of the capacitor C7 through diode D10, relay coil K1' and capacitor C6 activating the relay coil K1' for one-half cycle and leaving enough residual charge on the sustaining capacitor C6 to hold in the relay coil K1' for the remaining half of the cycle as the capacitor C7 refreshes itself by recharging during the following positive half wave cycle.

In particular, on the positive half wave cycle swing of the 24 volt alternating current source, both capacitors C5 and C7 charge to the peak of the voltage swing as the transistor Q5 prevents the field effect transistor Q2 from conducting during the positive half wave cycle, the capacitor C5 charging through diode D20, resistor R7 and diode D2 while the capacitor C7 charges through the zener diode Z2, diodes D15 and D13, resistor R8 and diode D3.

In this manner, the relay coil K1' will remain activated as long as there is a negative voltage applied to the gate 78 of the field effect transistor Q2 and this voltage is supplied by the timed discharge of capacitor C4.

The zener diode Z2 is utilized to limit the magnitude of voltage transfer by the capacitor C7 to the relay control circuit section 75 by causing the capacitor C7 to discharge through the diode D17 and the diode D20 to the zener voltage. The diodes D3, D13 and D15 in the circuit section 75 provide three levels of protection against shorting, these diodes being rated for ten times the actual amount of current they handle.

Thus, it can be seen that the failure of any other individual component in any mode will act to stop gas flow.

For example, should the silicon controlled rectifier Q6 degenerate into a noncontrolled rectifier, the same will continuously ground the capacitor C7 so that the capacitor C7 cannot be charged at any time to cause the relay coil means K1' to be activated and since the relay coil means K1' can not be activated, the contacts K1 are open so that no current can flow to the valve means 29 and 30 to operate the same.

In regard to the operation of the control circuit section 76 for the main gas valve relay control circuit section 77, the source of negative voltage for the gate 79 of the field effect transistor Q3 is supplied by the flame sense probe 34 having been rectified by the flames at the pilot burner means 24 so that a source of negative voltage is always supplied to the gate 79 of the field effect transistor Q3 as long as the probe 34 is sensing a flame means at the pilot burner means 24. The transistor Q7 causes the field effect transistor Q3 to be non-conducting on each half wave cycle of positive polarity and thereby permits the capacitors C8 and C10 to charge to the peak of the voltage swing, the capacitor C8 charging through the diode D23, the resistor R10 and the diode D4 while the capacitor C10 charges through the zener diode Z3, the diode D16, the diode D14, the resistor R11 and the diode D5. On each half wave cycle of negative polarity, the transistor Q7 causes the field effect transistor Q3 to conduct thereby essentially grounding the anode of the capacitor C8 causing it to discharge through the field effect transistor Q3, the diode D18 and the resistor R26 which develops a voltage across R26 with a polarity such as to cause the cathode of the silicon controlled rectifier Q8 to be negative with respect to its gate forcing the silicon controlled rectifier Q8 into conduction. The conduction of the silicon controlled rectifier Q6 allows discharge of the capacitor C10 through the diode D11, the relay coil K2' and the capacitor C9 activating the relay coil K2' for one-half wave cycle and leaving enough residual charge on the capacitor C9 to hold in the relay coil K2' for the remainder of the half wave cycle as the capacitor C10 refreshes itself by recharging during the following half wave cycle of positive polarity.

The zener diode Z3 is utilized in the circuit section 77 to limit the magnitude of voltage transferred by the capacitor C10 to the relay circuit section 77 by causing the capacitor C10 to discharge through the diodes D18 and D23 to the zener voltage. The diodes D5, D14 and D16 are provided to give three levels of protection against shorting as the diodes are rated for ten times the actual amount of current they handle.

Thus, it can be seen that if a failure of the silicon controlled rectifier Q8 occurs, such as it having the silicon controlled rectifier Q8 degenerate into a noncontrolled rectifier, the capacitor C10 cannot charge and thereby cannot cause the coil means K2' to be activated whereby all flow of main gas to the main burner means 26 will be terminated.

Since the timing capacitor C4 for the control circuit section 74 would eventually dissipate all of its negative voltage by imposing that negative voltage upon the gate 78 of the field effect transistor Q2, the main gas relay circuit section 77 refreshes the charging on the capacitor C4 through a line 80 of the circuit means 38 that has the diode D7 and the resistor R12 therein whereby on each cycle that a recharging of the capacitor C10 takes place, a recharging of the capacitor C4 also takes place.

Therefore, it can be seen that when the thermostat means 39 of the control means 20 of this invention closes the switch blade 40 against the fixed contact means 44 so as to activate the circuit means 38 by imposing the low voltage alternating current source of the transformer 45 thereon, the timing circuit section 72 will eventually have the capacitor C4 thereof provide a negative voltage on the gate 78 of the field effect transistor Q2 and the transistor Q5 will cause the field effect transistor Q2 to conduct on each negative half wave cycle of the alternating current source and be nonconductive on each half wave cycle of positive polarity thereof so that in effect the capacitors C5 and C7 of the pilot gas relay control circuit section 75 will charge on each half wave cycle of positive polarity and discharge on each half wave cycle of negative polarity, the capacitor C7 discharging through the relay coil means K1' and the sustaining capacitor means C6 maintaining the energization of the coil means K1' during the recharging of the capacitor means C7 whereby the relay contacts K1 will be maintained in a closed condition as long as a negative voltage is being imposed on the gate 78 of the field effect transistor Q2 and the thermostat means 39 is in a closed condition thereof.

Similarly, as long as there is a flame means at the pilot burner means 24, the flame sense means 35 maintains a negative voltage on the gate 79 of the field effect transistor Q3 and the transistor Q7 causes the field effect transistor Q3 to conduct on each half wave cycle of negative polarity and to be nonconducting on each half wave cycle of positive polarity, the capacitors C8 and C10 charging on each half wave cycle of positive polarity with the discharging of the capacitor C10 energizing the relay coil means K2' as the capacitor C10 discharges and the capacitor C10 maintaining the charge through the relay coil K2' while the capacitor C10 is recharging whereby the relay contacts K2 remain closed and the relay contacts K2" remain open as long as a negative voltage is being imposed on the gate 79 of the field effect transistor Q3 and the thermostat construction 39 is in a closed conidition thereof.

From the above, it can be seen that when comparing the circuit means 38 of this invention with the circuit means of the FIG. 4 embodiment of the aforementioned Geary U.S. Pat. No. 4,626,192, the silicon controlled rectifiers Q6 and Q8 in the circuit sections 75 and 77 of this invention, in effect, respectively replace the transistors Q11, Q12 and Q5, Q6 and the small one watt resistors R8 and R11 of the circuit means 38 of this invention, in effect, replace the 7 watt resistors R31 and R8 thereof, each replaced 7 watt resistor being approximately one and one-half inches long and requiring the same to be mounted on the circuit board in raised spaced relation thereto so as to dissipate the high heat thereof whereas the one watt resistors R8 and R11 of this invention are approximately 0.4 of an inch long and do not produce an adverse heating effect as provided by the replaced resistors.

Therefore, it can be seen that the control means 20 of this invention provides the same degree of operation with fewer components, lower heat generation and potentially longer life for the associated components in addition to being able to utilize less space in the furnace application because of the smaller circuit board required for this design.

Thus, it can be seen that this invention not only provides a new control means for a gas furnace or the like, but also this invention provides a new method of making such a control means and the like.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement? and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a control means for a gas furnace, said control means comprising an electrically operable pilot gas valve means, a source of alternating current, an electrical circuit means adapted to be interconnected to said source of alternating current so as to have alternating half wave cycles of one polarity and half wave cycles of the opposite polarity, said circuit means having a timing section and a pilot gas valve means section, and a thermostat for interconnecting said circuit means to said source of alternating current, said pilot gas valve means section comprising a pilot relay coil means which when energized by said circuit means is adapted to operate said pilot gas valve means to direct pilot gas to said furnace, said timing section comprising a control unit that is adapted to energize said pilot relay coil means on each half wave cycle of said one polarity thereof only after a certain time period has elapsed from the time said timing section means is activated, the improvement wherein said pilot gas valve means section comprises a silicon controlled rectifier and a first capacitor and a second capacitor so electrically interconnected together that said capacitors are adapted to be charged one each half wave cycle of said opposite polarity thereof and that said second capacitor is adapted to discharge through said pilot relay coil means only when said silicon controlled rectifier conducts, said silicon controlled rectifier being adapted to conduct only when said first capacitor is discharged, said timing section being adapted to discharge said first capacitor only on each half wave cycle of said one polarity thereof, said furnace having an electrically operable main gas valve means, said circuit means having a flame sense section and a main gas valve means section, said main gas valve means section comprising a main relay coil means which when energized by said circuit means is adapted to operate said main gas valve means to direct main gas to said furnace, said flame sense section comprising a second control unit that is adapted to energize said main relay coil means on each half wave cycle of said one polarity thereof when a flame sense probe means generates a voltage through flame rectification thereof caused by pilot flame means of said furnace impinging on said probe means, said main gas valve means section comprising a second silicon controlled rectifier and a third capacitor and a fourth capacitor so electrically interconnected together that said third and fourth capacitors are adapted to be charged on each half wave cycle of said opposite polarity thereof and that said fourth capacitor is adapted to discharge through said main relay coil means to energize said main relay coil means only when said second silicon controlled rectifier conducts, said second silicon controlled rectifier being adapted to conduct only when said third capacitor is discharged, said flame sense section being adapted to discharge said third capacitor only on each half wave cycle of said one polarity thereof.

2. A control means as set forth in claim 1 wherein said main gas valve means section comprises sustaining capacitor means connected in parallel with said main relay coil means and being effective to maintain energization of said main relay coil means during recharging of said fourth capacitor on each half wave cycle of said opposite polarity.

3. A control means as set forth in claim 1 wherein said second control unit comprises a field effect transistor and a switching transistor that is driven by said alternating current of said circuit means and causes said field effect transistor to conduct on each half wave cycle of said one polarity, said field effect transistor being adapted to cause said third capacitor to discharge when said field effect transistor conducts.

4. A control means as set forth in claim 1 wherein said pilot gas valve means section comprises sustaining capacitor means connected in parallel with said pilot relay coil means and being effective to maintain energization of said pilot relay coil means during recharging of said second capacitor on each half wave cycle of said opposite polarity.

5. A control means as set forth in claim 1 wherein said control unit comprises a field effect transistor and a switching transistor that is driven by said alternating current of said circuit means and causes said field effect transistor to conduct on each half wave cycle of said one polarity, said field effect transistor being adapted to cause said first capacitor to discharge when said field effect transistor conducts.

6. A control means as set forth in claim 1 wherein said electrical circuit means has a spark generating section that comprises means for igniting pilot gas initially emanating from said pilot gas valve means for a certain time period after said spark generating section has been activated.

* * * * *

UNITED STATES PATENT AND TRADEMARK OFFICE

CERTIFICATE OF CORRECTION

PATENT NO. : 4,971,549

DATED : November 20, 1990

INVENTOR(S) : Frederick J. Geary

It is certified that error appears in the above—identified patent and that said Letters Patent is hereby corrected as shown below:

Column 10, line 45, cancel "one" and insert --on--.

Signed and Sealed this

First Day of September, 1992

*Attest:*

DOUGLAS B. COMER

*Attesting Officer*

*Acting Commissioner of Patents and Trademarks*